US009953619B2

(12) United States Patent
Li et al.

(10) Patent No.: US 9,953,619 B2
(45) Date of Patent: Apr. 24, 2018

(54) DISPLAY RECORDING INFORMATION AND GENERATION METHOD THEREOF

(71) Applicant: Raydium Semiconductor Corporation, Hsinchu (TW)

(72) Inventors: Hung Li, Taipei (TW); Feng-Li Lin, Hsinchu (TW); Shua Shen Hsiao, Chiayi (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 96 days.

(21) Appl. No.: 15/236,670

(22) Filed: Aug. 15, 2016

(65) Prior Publication Data

US 2017/0103734 A1 Apr. 13, 2017

(30) Foreign Application Priority Data

Oct. 8, 2015 (TW) ..... 104133245 A

(51) Int. Cl.
*G09G 5/39* (2006.01)
*G09G 5/00* (2006.01)

(52) U.S. Cl.
CPC ..... *G09G 5/39* (2013.01); *G09G 5/006* (2013.01); *G09G 2320/10* (2013.01); *G09G 2340/02* (2013.01); *G09G 2350/00* (2013.01); *G09G 2360/128* (2013.01)

(58) Field of Classification Search
None
See application file for complete search history.

(56) References Cited

U.S. PATENT DOCUMENTS 6,140,992 A * 10/2000 Matsuzaki ..... G06F 3/147 345/100
8,022,909 B2 * 9/2011 Shuford ..... G09G 3/3685 345/89
2011/0304522 A1 * 12/2011 Zeng ..... G09G 5/006 345/1.1

* cited by examiner

*Primary Examiner* — Sultana M Zalalee

(57) ABSTRACT

A display recording information and generation method thereof are disclosed. The display recording information is used to record the corresponding relationship between the display information received by a driving IC of a display and pixels of the display. The display recording information is formed by one byte (8 bits). Its first bit through six bit record a counting result that a number counter or a column counter performs a six-bit counting on a number of pixels or a number of columns of pixels starting from 0; its seventh bit uses 0 or 1 to record that the counting result belongs to the number of pixels or a number of columns of pixels; its eighth bit uses 1 to record that a most significant bit of the display information including red, green, or blue is 1, otherwise uses 0 to record.

12 Claims, 3 Drawing Sheets

1A

| B8 | B7 | B6 | B5 | B4 | B3 | B2 | B1 |
|---|---|---|---|---|---|---|---|
| 0/1 | 0/1 | 0~63 | | | | | |

FIG. 1A

1B

| B8 | B7 | B6 | B5 | B4 | B3 | B2 | B1 |
|---|---|---|---|---|---|---|---|
| 0 | 0 | 0 | | | | | |

FIG. 1B

1C

| B8 | B7 | B6 | B5 | B4 | B3 | B2 | B1 |
|---|---|---|---|---|---|---|---|
| 0 | 1 | 2 | | | | | |

FIG. 1C

1D

| B8 | B7 | B6 | B5 | B4 | B3 | B2 | B1 |
|---|---|---|---|---|---|---|---|
| 1 | 0 | 6 | | | | | |

FIG. 1D

2

| | P1 | P2 | P3 | P4 | ..... | P(N-1) | PN |
|---|---|---|---|---|---|---|---|
| L 1 | | | | | ..... | | |
| L 2 | | | | | ..... | | |
| L 3 | | | | | ..... | | |
| . | | | | | ..... | | |
| . | | | | | ..... | | |
| . | | | | | ..... | | |
| L (M-1) | | | | | ..... | | |
| LM | | | | | ..... | | |

FIG. 2

DISPLAY RECORDING INFORMATION AND GENERATION METHOD THEREOF

BACKGROUND OF THE INVENTION

1. Field of the Invention

This invention relates to a display apparatus, especially to a display recording information and a generation method capable of reducing the data storage space and maintaining good image quality at the same time.

2. Description of the Prior Art

In general, the conventional display driving IC includes a frame RAM (or a frame buffer). When the frame displayed by the panel needs not to be refreshed, the display driving IC will stop receiving new display data from the data source, and the only thing that the display driving IC needs to do is to access and output the display data previously stored in the frame RAM (or the frame buffer). Therefore, it can achieve the effects of saving the data transmission power.

However, with the increasing of the resolution of the display, the capacity of the frame RAM (or the frame buffer) needed and the area of the display driving IC will also become larger. In addition, the manufacturing process of the display driving IC will also become more advanced and complicated due to the needs of higher memory density. These factors will cause the largely increasing of the costs of the display driving IC.

In order to improve the above-mentioned drawbacks, "the RAM-Less driving IC" is generated accordingly. As the name suggests, the RAM-Less driving IC does not include the frame RAM (or the frame buffer). However, this also means that the RAM-Less driving IC has to continuously obtain new display data from the data source. It will also largely increase the data transmission power.

Therefore, if the quality of the display screen is not so important, the display driving IC can use the "1 bit RAM" technology to store the 24 bits input display data in the 1 bit memory capacity, so that the size of the memory can be largely reduced. When the frame displayed by the panel needs not to be refreshed, the only thing that the display driving IC needs to do is to access the display data previously stored in the frame RAM (or the frame buffer) and perform color transformation on it and then output it to the panel; therefore, the data transmission power can be also reduced. However, the biggest drawback is that high compression led to a substantial decline in the quality of the display image, so that the display will fail to provide the display image having good quality.

SUMMARY OF THE INVENTION

Therefore, the invention provides a display recording information and a generation method thereof to solve the above-mentioned problems in the prior arts.

An embodiment of the invention is a display recording information. In this embodiment, the display recording information is used to record a corresponding relationship between a display information received by a driving IC of a display and a plurality of pixels of a panel of the display. The display recording information is formed by one byte including eight bits. The display recording information includes a first bit, a second bit, . . . , and an eighth bit. The first bit through the six bit are configured to record a counting result that a number counter or a column counter performs a six-bit counting on a number of the plurality of pixels or a number of columns of the plurality of pixels starting from 0. The seventh bit is configured to use 0 or 1 to record whether the counting result belongs to the number of the plurality of pixels or the number of columns of the plurality of pixels. The eighth bit is configured to use 1 to record that a most significant bit of the display information including red, green or blue is 1, and use 0 to record otherwise.

In an embodiment, if the display information is the same with a former display information, a counting of the number counter adds 1.

In an embodiment, when the counting of the number counter accumulates to a maximum allowed by six bits, the first bit through the eighth bit at this time are stored in a register and the counting of the number counter becomes 0.

In an embodiment, if the number of columns of the plurality of pixels is M and each column includes N pixels, M and N are both positive integers, when the counting of the number counter accumulates to N, the first bit through the eighth bit at this time are stored in a register and the counting of the number counter adds 1.

In an embodiment, if the display information is different from a former display information, the first bit through the eighth bit at this time are stored in a register and the counting of the number counter becomes 1.

In an embodiment, if the number of columns of the plurality of pixels is M and each column includes N pixels, M and N are both positive integers, when a N-th pixel of the each column is counted, the first bit through the eighth bit at this time are stored in a register and the counting of the number counter becomes 0.

Another embodiment of the invention is a display recording information generation method. In this embodiment, the display recording information generation method is used to generate a display recording information to record a corresponding relationship between a display information received by a driving IC of a display and a plurality of pixels of a panel of the display. The display recording information includes one byte including eight bits. The display recording information generation method further includes steps of: recording a counting result that a number counter or a column counter performs a six-bit counting on a number of the plurality of pixels or a number of columns of the plurality of pixels starting from 0 in a first bit through a six bit of the byte; using 0 or 1 to record whether the counting result belongs to the number of the plurality of pixels or the number of columns of the plurality of pixels to obtain a seventh bit of the byte; and using 1 to record that a most significant bit of the display information including red, green or blue is 1 and using 0 to record otherwise to obtain an eighth bit of the byte.

Compared to the prior arts, although the display recording information and the display recording information generation method of the invention also use the "1 bit RAM" to largely reduce the necessary size of memory and reduce the data transmission power, the display recording information and the display recording information generation method of the invention further use specific compression method to compress the display data at first and then store the compressed display data in the 1 bit RAM. When the frame displayed by the panel needs not to be refreshed, the display driving IC only needs to access the compressed display data previously stored in the 1 bit RAM and perform color transformation on it and then output it to the panel without reducing the quality of the display image.

Therefore, the display recording information and the display recording information generation method of the invention can achieve the effects of reducing the data storage space, saving the data transmission power, reducing the costs of the driving IC of the display and enhancing the quality of the display image, so that the drawbacks of the prior arts can be effectively improved and the market competitiveness of the display driving IC can be also largely enhanced.

The advantage and spirit of the invention may be understood by the following detailed descriptions together with the appended drawings.

BRIEF DESCRIPTION OF THE APPENDED DRAWINGS

FIG. 1A illustrates a schematic diagram of the display recording information in a preferred embodiment of the invention.

FIG. 1B-FIG. 1D illustrate schematic diagrams of the display recording information in different embodiments respectively.

FIG. 2 illustrates a schematic diagram of the display panel including M columns of pixels and each column including N pixels.

DETAILED DESCRIPTION OF THE INVENTION

Figure 3:
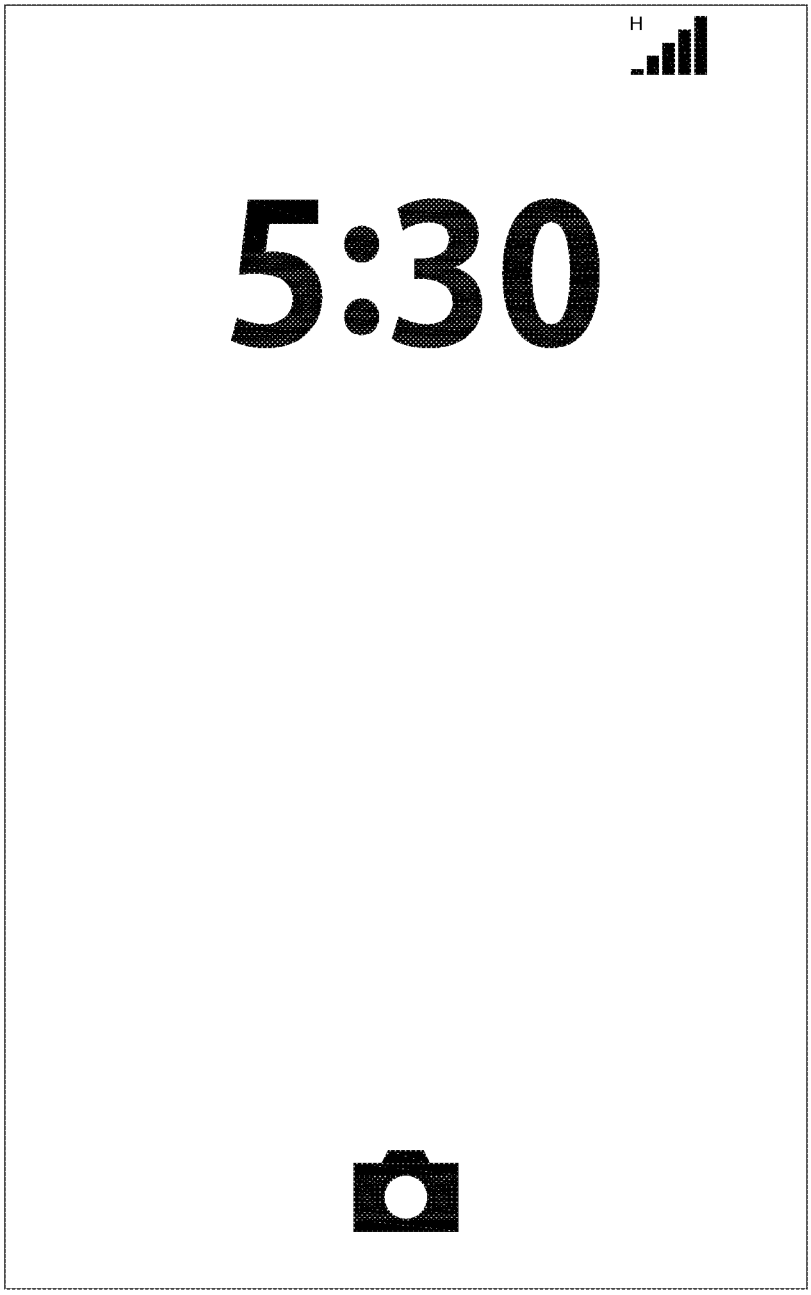
FIG. 3 illustrates a frame having a resolution of (1080*1920) displayed on the panel of the smart phone.

A preferred embodiment of the invention is a display recording information. In this embodiment, the display recording information is used in a display apparatus to record a corresponding relationship between a display information received by a driving IC of a display and a plurality of pixels of a panel of the display, but not limited to this.

Please refer to FIG. 1. FIG. 1A illustrates a schematic diagram of the display recording information in this embodiment. As shown in FIG. 1A, the display recording information is formed by one byte including eight bits (a first bit B1, a second bit B2, . . . , and an eighth bit B8).

The first bit B1, the second bit B2, . . . , and the six bit B6 are configured to record a counting result that a number counter or a column counter performs a six-bit counting on a number of the plurality of pixels or a number of columns of the plurality of pixels starting from 0. Because the first bit B1, the second bit B2, . . . , and the six bit B6 are all 0 or 1, the counting of the first bit B1, the second bit B2, . . . , and the six bit B6 can be operated from 0 to 63.

The seventh bit B7 is configured to use 0 or 1 to record whether the counting result recorded by the first bit B1, the second bit B2, . . . , and the six bit B6 belongs to the number of the plurality of pixels or the number of columns of the plurality of pixels. For example, if the counting result recorded by the first bit B1, the second bit B2, . . . , and the six bit B6 belongs to the number of the plurality of pixels, then the seventh bit B7=0; if the counting result recorded by the first bit B1, the second bit B2, . . . , and the six bit B6 belongs to the number of columns of the plurality of pixels, then the seventh bit B7=1.

The eighth bit B8 is configured to record whether a most significant bit of the display information including red, green or blue is 1. For example, if the eighth bit B8 is 1, it means that the display information includes red, green or blue; if the eighth bit B8 is 0, it means that the display information does not include any red, green or blue.

In another embodiment, as shown in FIG. 1C, if the counting result of the first bit B1, the second bit B2, . . . , and the six bit B6 of the display record information IC is 2, the seventh bit B7 is 1 and the eighth bit B8 is 0, it means that the first bit B1, the second bit B2, . . . , and the six bit B6 are used to record the counting of the number of columns of the plurality of pixels and the counting is 2 and the display information does not include any red, green or blue.

In another embodiment, as shown in FIG. 1D, if the counting result of the first bit B1, the second bit B2, . . . , and the six bit B6 of the display record information 1D is 6, the seventh bit B7 is 0 and the eighth bit B8 is 1, it means that the first bit B1, the second bit B2, . . . , and the six bit B6 are used to record the counting of the number of the plurality of pixels and the counting is 6 and the display information at least includes red, green or blue.

Next, the counting regulations and performing methods of the display record information in this embodiment will be introduced in detail.

(1) At first, a 6-bits number counter or a 6-bits column counter in the display apparatus are both set 0. In other words, both the 6-bits number counter and the 6-bits column counter in the display apparatus will count starting from [000000].

(2) If the display information is the same with a former display information, a counting of the number counter will add 1. For example, if the beginning three display data (a first display data, a second display data and a third display data) are all the same, then the counting of the number counter will add 2. That is to say, the counting of the number counter will be changed from [000000] to [000010].

(3) If the display information is different from the former display information, the first bit B1, the second bit B2, . . . , and the eighth bit B8 of the current display data at this time will be stored in the register and the counting of the number counter will become 1. For example, if the second display data is different from the first display data, then the first bit B1, the second bit B2, . . . , and the eighth bit B8 of the second display data will be stored in the register and the counting of the number counter will be set as [000001].

(4) When the counting of the number counter already accumulates to a maximum value [111111] allowed by six bits, namely the counting of the number counter is already changed from 0 to 63, the first bit B1, the second bit B2, . . . , and the eighth bit B8 of the current display data at this time will be stored in the register and the counting of the number counter will become 0, namely the counting of the number counter will be changed to [000000].

(5) As shown in FIG. 2, if the panel 2 includes M columns of pixels (e.g., a first column of pixels L1~a M-th column of pixels LM) and each column of pixels includes N pixels (e.g., a first pixel P1~a N-th pixel PN), wherein M and N are both positive integers. When the counting of the number counter accumulates to N, the first bit B1, the second bit B2, . . . , and the eighth bit B8 of the current display data at this time will be stored in the register and the counting of the number counter will add 1. Taking the first column of pixels L1 as an example, if the first column of pixels L1 includes six pixels P1~P6, when the counting of the number counter accumulates to 6, namely the counting of the number counter is [000110], the first bit B1, the second bit B2, . . . , and the eighth bit B8 of the current display data at this time will be stored in the register and the counting of the number counter will be changed from [000000] to [000001].

(6) Please refer to (2), when the number of the same display data reaches N (which is the number of pixels in a column), the counting of the column counter will add 1. The first bit B1, the second bit B2, . . . , and the eighth bit B8 of the current display data at this time will be stored in the register and the storing position of the counting information of the column counter will be back to a suitable position to replace the originally stored counting information of the number counter.

Please refer to FIG. 3. FIG. 3 illustrates a frame having a resolution of (1080*1920) displayed on the panel of the smart phone.

Taking the storing way of the prior art as an example, the 1 bit memory capacity is used to store 24 bits input display information; therefore, the frame having a resolution of (1080*1920) shown in FIG. 3 needs a storage space of 1080* 1920=2073600 bits=159200 bytes to store.

Taking the storing way of the invention as another example, if the height of the black word section in the frame of FIG. 3 is 192 columns of pixels and the number of the color changing times of each column is no more than 20, then the frame having a resolution of (1080*1920) shown in FIG. 3 only needs a storage space smaller than 7500 bytes which is only about 2.9% of the storage space needed in the prior art. Therefore, the size of the data storage space needed in the invention can be largely reduced.

Another embodiment of the invention is a display recording information generation method. In this embodiment, the display recording information generation method can be used to generate a display recording information to record a corresponding relationship between a display information received by a driving IC of a display and a plurality of pixels of a panel of the display, but not limited to this.

It should be noticed that the display recording information generated by the display recording information generation method includes one byte including eight bits (a first bit B1, a second bit B2, . . . , an eighth bit B8).

Figure 4:
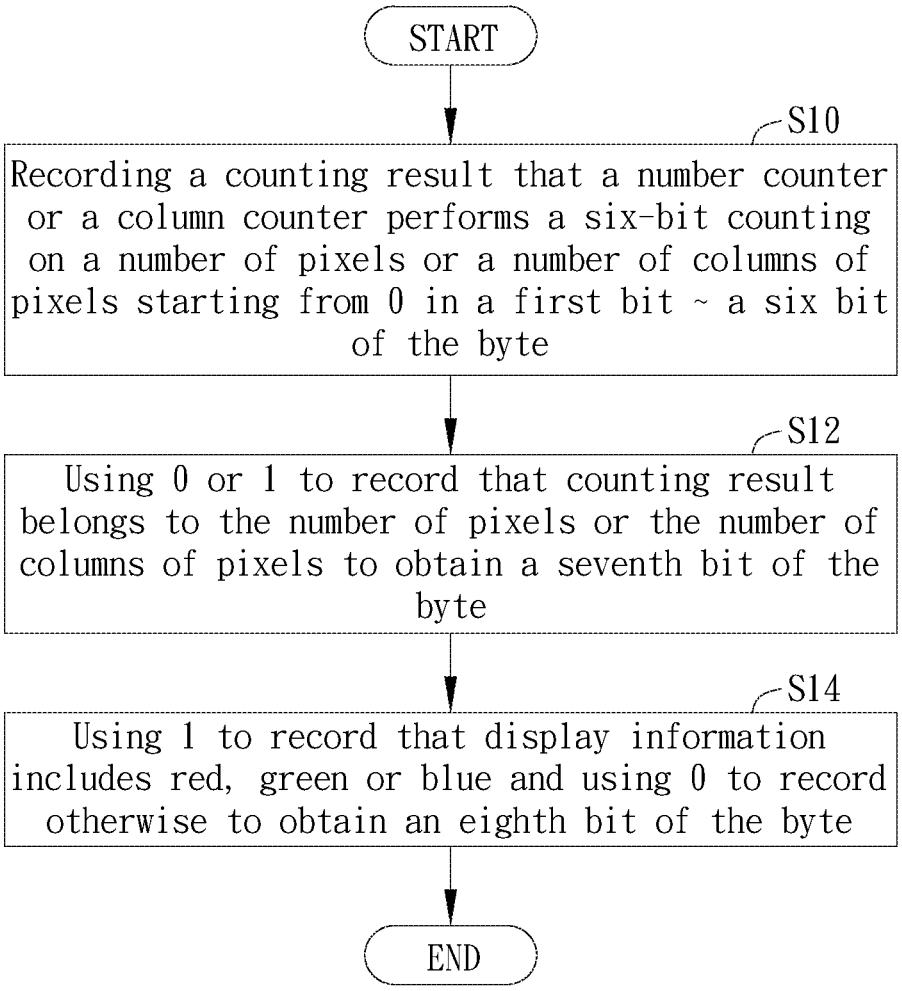
FIG. 4 illustrates a flowchart of the display recording information generation method in another preferred embodiment of the invention.

Then, please refer to FIG. 4. FIG. 4 illustrates a flowchart of the display recording information generation method in another preferred embodiment of the invention.

As shown in FIG. 4, the display recording information generation method in this embodiment includes the following steps of:

Step S10: Recording a counting result that a number counter or a column counter performs a six-bit counting (0~63) on a number of the plurality of pixels or a number of columns of the plurality of pixels starting from 0 in a first bit through a six bit of the byte;

Step S12: Using 0 or 1 to record that the counting result belongs to the number of the plurality of pixels or the number of columns of the plurality of pixels to obtain a seventh bit of the byte;

Step S14: Using 1 to record that the display information includes red (R), green (G) or blue (B) and using 0 to record otherwise to obtain an eighth bit of the byte.

Compared to the prior arts, although the display recording information and the display recording information generation method of the invention also use the "1 bit RAM" to largely reduce the necessary size of memory and reduce the data transmission power, the display recording information and the display recording information generation method of the invention further use specific compression method to compress the display data at first and then store the compressed display data in the 1 bit RAM. When the frame displayed by the panel needs not to be refreshed, the display driving IC only needs to access the compressed display data previously stored in the 1 bit RAM and perform color transformation on it and then output it to the panel without reducing the quality of the display image.

Therefore, the display recording information and the display recording information generation method of the invention can achieve the effects of reducing the data storage space, saving the data transmission power, reducing the costs of the driving IC of the display and enhancing the quality of the display image, so that the drawbacks of the prior arts can be effectively improved and the market competitiveness of the display driving IC can be also largely enhanced.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A display recording information used to record a corresponding relationship between a display information received by a driving IC of a display and a plurality of pixels of a panel of the display, the display recording information being formed by one byte comprising eight bits, the display recording information comprising:

a first bit through a six bit configured to record a counting result that a number counter or a column counter performs a six-bit counting on a number of the plurality of pixels or a number of columns of the plurality of pixels starting from 0;

a seventh bit configured to use 0 or 1 to record whether the counting result belongs to the number of the plurality of pixels or the number of columns of the plurality of pixels; and an eighth bit configured to use 1 to record that a most significant bit of the display information comprising red, green or blue is 1, and use 0 to record otherwise.

2. The display recording information of claim 1, wherein if the display information is the same with a former display information, a counting of the number counter adds 1.

3. The display recording information of claim 2, wherein when the counting of the number counter accumulates to a maximum allowed by six bits, the first bit through the eighth bit at this time are stored in a register and the counting of the number counter becomes 0.

4. The display recording information of claim 2, wherein if the number of columns of the plurality of pixels is M and each column comprises N pixels, M and N are both positive integers, when the counting of the number counter accumulates to N, the first bit through the eighth bit at this time are stored in a register and the counting of the number counter adds 1.

5. The display recording information of claim 1, wherein if the display information is different from a former display information, the first bit through the eighth bit at this time are stored in a register and the counting of the number counter becomes 1.

6. The display recording information of claim 1, wherein if the number of columns of the plurality of pixels is M and each column comprises N pixels, M and N are both positive integers, when a N-th pixel of the each column is counted, the first bit through the eighth bit at this time are stored in a register and the counting of the number counter becomes 0.

7. A display recording information generation method used to generate a display recording information to record a corresponding relationship between a display information received by a driving IC of a display and a plurality of pixels of a panel of the display, the display recording information comprising one byte comprising eight bits, the display recording information generation method further comprising steps of:

recording a counting result that a number counter or a column counter performs a six-bit counting on a number of the plurality of pixels or a number of columns of the plurality of pixels starting from 0 in a first bit through a six bit of the byte;

using 0 or 1 to record whether the counting result belongs to the number of the plurality of pixels or the number of columns of the plurality of pixels to obtain a seventh bit of the byte; and using 1 to record that a most significant bit of the display information comprising red, green or blue is 1 and using 0 to record otherwise to obtain an eighth bit of the byte.

8. The display recording information generation method of claim 7, wherein if the display information is the same with a former display information, a counting of the number counter adds 1.

9. The display recording information generation method of claim 8, wherein when the counting of the number counter accumulates to a maximum allowed by six bits, the first bit through the eighth bit at this time are stored in a register and the counting of the number counter becomes 0.

10. The display recording information generation method of claim 8, wherein if the number of columns of the plurality of pixels is M and each column comprises N pixels, M and N are both positive integers, when the counting of the number counter accumulates to N, the first bit through the eighth bit at this time are stored in a register and the counting of the number counter adds 1.

11. The display recording information generation method of claim 7, wherein if the display information is different from a former display information, the first bit through the eighth bit at this time are stored in a register and the counting of the number counter becomes 1.

12. The display recording information generation method of claim 7, wherein if the number of columns of the plurality of pixels is M and each column comprises N pixels, M and N are both positive integers, when a N-th pixel of the each column is counted, the first bit through the eighth bit at this time are stored in a register and the counting of the number counter becomes 0.

* * * * *